US007244041B2

(12) United States Patent
Woog

(10) Patent No.: US 7,244,041 B2
(45) Date of Patent: Jul. 17, 2007

(54) SAFETY CANDLE

(76) Inventor: Gunter Woog, 5435 Bauers Dr., West Bend, WI (US) 53095

( * ) Notice: Subject to any disclaimer, the term of this patent is extended or adjusted under 35 U.S.C. 154(b) by 0 days.

(21) Appl. No.: 10/452,611

(22) Filed: Jun. 2, 2003

(65) Prior Publication Data

US 2004/0240200 A1 Dec. 2, 2004

(51) Int. Cl.
*F23D 1/00* (2006.01)
*F21L 19/00* (2006.01)

(52) U.S. Cl. ..... 362/161; 431/253

(58) Field of Classification Search ..... 362/161, 362/181, 101, 163; 431/288, 289, 253
See application file for complete search history.

(56) References Cited

U.S. PATENT DOCUMENTS 2,254,664 A * 9/1941 Quinlan ..... 362/163
4,332,548 A 6/1982 Linton et al.
4,415,329 A 11/1983 Dodd
4,937,701 A * 6/1990 Schroder ..... 362/161
5,803,587 A 9/1998 Chen
5,871,553 A 2/1999 Spaulding
5,980,241 A 11/1999 Schirneker
6,179,437 B1 1/2001 Hardy et al.
6,241,513 B1 6/2001 Jeneral
6,296,477 B1 10/2001 Lin
6,315,433 B1 11/2001 Cavello
6,439,471 B2 8/2002 Ehrlich et al.
2001/0036609 A1* 11/2001 Ehrlich et al. ..... 431/253
2002/0185410 A1* 12/2002 Travis-Pence ..... 206/736

FOREIGN PATENT DOCUMENTS

SE 8400212 A * 7/1985

* cited by examiner

*Primary Examiner*—Sandra O'Shea
*Assistant Examiner*—James W Cranson, Jr.
(74) *Attorney, Agent, or Firm*—Boyle Fredrickson Newholm Stein & Gratz S.C.

(57) ABSTRACT

A safety candle comprising: a tea light candle holder and at least one tea light candle insert.

2 Claims, 3 Drawing Sheets

SAFETY CANDLE

FIELD OF THE INVENTION

The present invention relates to safety candles.

BACKGROUND OF THE INVENTION

U.S. Pat. No. 4,337,548 relates to a candle safety disc and candle. A transparent safety layer for a transparent candle comprising a thermoplastic polyamide resin and a solvent for said polyamide resin and said solvent being present in amounts to give said transparent safety layer a higher viscosity and melt temperature than said transparent candle composition. The invention permits preparation of transparent candle compositions which prevent flaring.

U.S. Pat. No. 4,415,329 relates to a decorative safety candle which has the exterior appearance of a traditional molded wax candle but is fueled by replaceable butane pressure cartridge. The butane cartridge is contained within an interior cylindrical metal casing, which is open at its bottom.

U.S. Pat. No. 6,296,477 relates to a container solid light candle with heat isolating effect. The candle oil is contained in the container. An inflammable and heat resistant solid heat isolating body is filled between the bottom of the candle oil and the bottom of the container. By means of the heat resistance of the solid heat isolating body, the heat generated by the burning candle oil is isolated from the table face so that the table face is protected from being burned or marked. When the candle oil is exhausted, by means of the inflammability of the solid heat isolating body, the flame of the candle wick will automatically go out to prevent the bottom of the container and the table face from being burned.

U.S. Pat. No. 6,439,471 relates to a candle fountain which includes a base defining a reservoir therein which is adapted to hold a fluid, such as water. A pump having an inlet and an outlet is provided in communication with the base reservoir. A candle member is supporting on the base, wherein the candle member includes a bore, formed at least partially there through having an inlet and a least one outlet. The bore inlet is in fluid communication with the pump outlet such that fluid can be pumped through the base resouvier into the bore and out through one or more bore outlets of the candle member.

U.S. Pat. No. 6,315,433 relates to a lighting fixture that functionally provides a mold for creating a light diffuser from ice, a stand upon which to display the created light diffuser, a collection element to collect and contain the melted light diffusing material and a support and containing system for a light source, that in use, is surrounded by the light diffuser.

U.S. Pat. No. 5,980,241 relates to a paraffin lamp having a container for a fuel with at least a partial cover in which there is a non combustible wick in a wick holder. Above the container near the wick holder is at least one roller or upright body or in the container there is a disc of solid fuel around the wick holder whereby the fuel of the roller and upright body or of the disc is melted by the flame and cover heat and collected by the container and/or the wick holder as supplementary fuel. The wick holder is suspended in an aperture of the container cover so that the wick holder is not in direct heat transmitting contact with the container base.

The invention relates to a tea light and lamp having a container for a fuel with a least a partial cover, and a non-combustible wick in a wick holder comprising a holder tube for the lower wick section from which funnel segments extend upwards to receive the fuel and transmitted heat; the invention further relates to a non-combustible wick and to the design of the fuel to be burned.

U.S. Pat. No. 6,179,437 relates to a unitary metal candle holder including a base and a plurality of panels integrally hinged to the base by a plurality of straps.

U.S. Pat. No. 5,871,553 relates to fragranced carrier compositions for use in tart candles. The fragranced carrier composition is comprised of a liquid base material of a hydrogenated polyolefin and a fragrance. The fragranced carrier composition may be poured into the reservoir of a tart candle from which the fragrance is caused to be dispensed by the heat from a flame.

U.S. Pat. No. 5,803,587 relates to a candle lantern which doubles as a decorative candle holder, comprising a body made from a tube of translucent material, for example, glass or plastic, and two interchangeable candle holding cups/heat shields mounted in the upper and lower ends of the tube, by set screws extending through holes in the tube. A base comprising a set of wire legs is preferably provided at the lower end of the tube, secured to the tube by the lower set of screws, while a retractable bail handle and optional rain shield are provided in the upper end of the tube and secured to the upper end set screw structure. In a preferred form, the candle holding cups include both blind apertures for receiving the set screws against the outer surface of the cup and a set of holes for allowing the set screws through the cup to engage undersized candles. The cup is sized to receive an ordinary tea light candle which may or may not be provided with its own disposable metal cup. When tea light candles are used, they fit closely enough to the cup that their mating fit alone is sufficient to hold a candle securely in place.

U.S. Pat. No. 6,241,513 relates to a polycarbonate thermoplastic plastic candle cup for a tea light candle having raised designs on the interior of the cup to increase the surface area on which non-liquid wax adheres, thus providing an insulating layer of non-liquid wax between the plastic and candle flame.

'Tea-light' candles, used for decorative or votive lighting or as source of heat for a chafing dish, are candles formed by introducing wax into either metal or flame-resistant plastic cups around a central wick. The typical tea-light candle burns for 4–6 hours in cups of 38 mm (1.5 in.) in. diameter and 15 mm. (⅜ in.) in height.

The cups, which retain the melted wax as the wick burns, are usually placed in non-flammable glass or ceramic candle holders that are well ventilated to allow heat conducted through the cup to dissipate by convection.

Plastic cups manufactured using injection molding techniques are a low cost alterative to metal cups for the tea-light candle, but plastic has an inherently lower ignition point than metal and conventional plastic cups have been known to ignite.

SUMMARY OF THE INVENTION

The present invention relates to a tea light candle holder and at least one tea light candle insert. It is an object of the invention to provide safe, spill proof wax cups that do not leak. It is an object of the invention to prevent damage and fire risk hazards. It is an object of the invention to provide low cost tea light inserts. It is an object of the present invention to minimize operating costs to less than a penny an hour. It is an object of the present invention to provide tea light candles which have an automatic shut off. It is an object of the present invention to provide self extinguishing safety candles which extinguish after approximately 4–6 hours. It is an object of present invention to provide candles which always look new and can last forever. It is an object of the present invention to provide a safety candle which has infinite design and decorating possibilities. It is an object of the present invention to provide clear plastic wax cups and translucent candle designs which make the product look like any other candle.

It is an object of the present invention to provide a tea light candle holder which is not effected by the flame from the tea light candle insert.

DETAILED DESCRIPTION OF THE INVENTION

The present invention relates to safety candles having tea light candle inserts. The tea light candle inserts are placed internally to the tea light candle holders. One or more tea light candle inserts can be placed in the tea light candle holder. In an embodiment, there can be several slots in the tea candle holder to place the tea light candle inserts. The tea light candle holders provide safe, spill proof wax cups that do not leak. The present invention prevents damage and fire risk hazards. The present invention provides low cost tea light inserts. The present invention minimizes operating costs to less than a penny an hour. The present invention provides tea light candles which have an automatic shut off. The present invention provides self extinguishing safety candles which extinguish after approximately 4–6 hours. The present invention provides candles which always look new and can last forever. The present invention provides a safety candle which has infinite design and decorating possibilities. The present invention provides clear plastic wax cups and translucent candle designs which make the product look like any other candle.

The present invention provides a tea light candle holder made of material which is not effected by the flame from the tea light candle insert. Examples of the material can be glass, metals, and non-flammable plastics.

Figure 1:
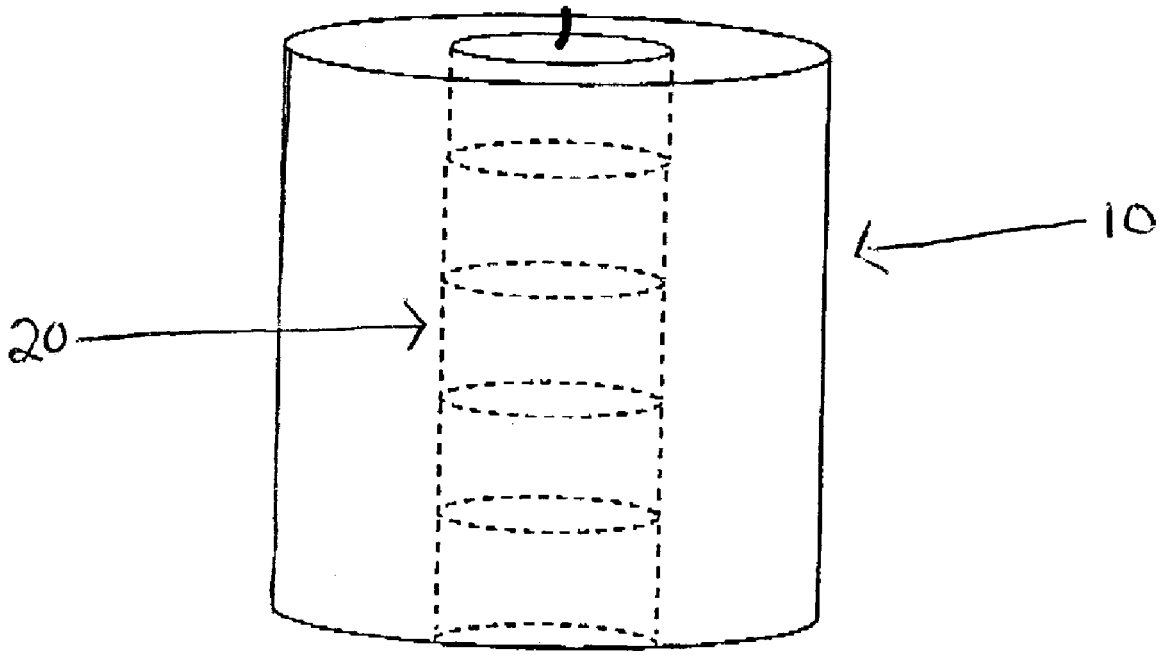
FIG. 1 is a cross-sectional view of the present invention.
Figure 2:
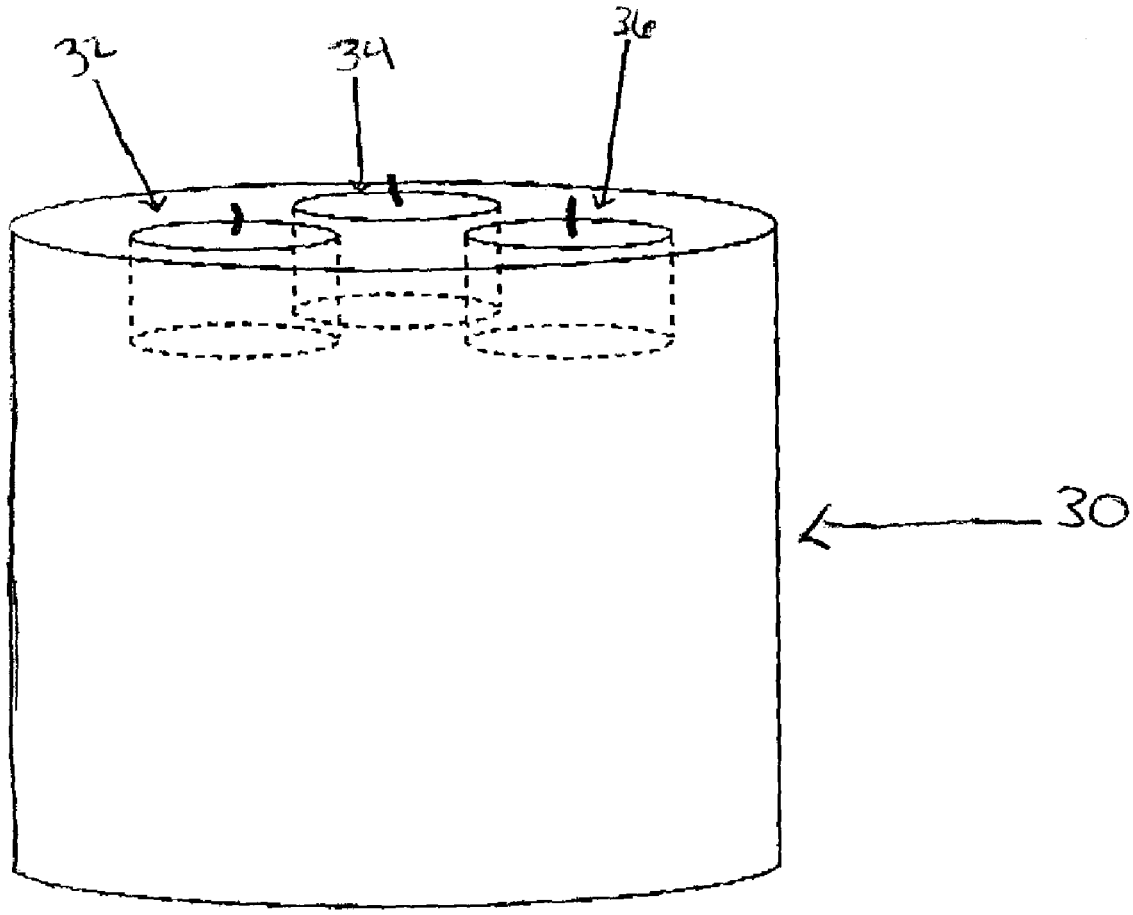
FIG. 2 is a cross sectional view of the present invention.
Figure 3:
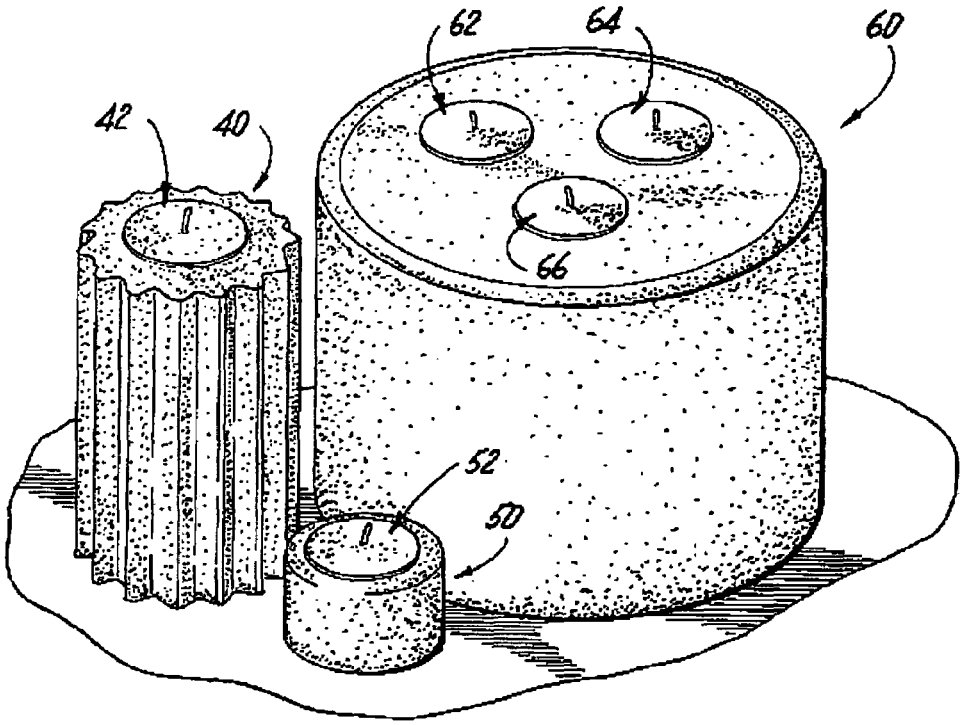
FIG. 3 is a side view of the present invention.

FIG. 1 is a cross-sectional view of the present invention. FIG. 1 is an embodiment which illustrates a tea light candle holder 10 having tea light candle inserts 20. FIG. 2 is an embodiment which illustrates a tea light candle holder 30 having tea light candle inserts 32, 34 and 36. FIG. 3 shows tea light candle holder 40 having candle insert 42, tea light candle holder 50 having tea light candle insert 52 and tea light candle holder 60 having tea light candle inserts 62, 64 and 66.

Figure 4:
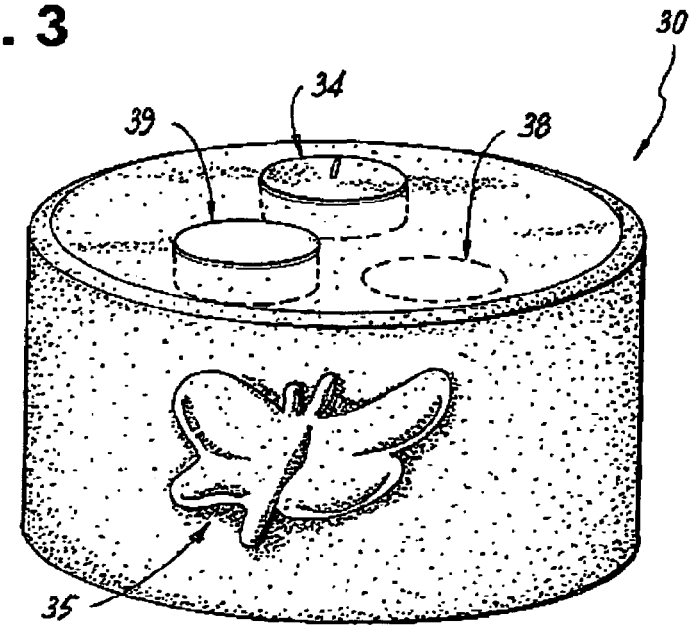
FIG. 4 is a cross sectional view of the present invention.

FIG. 4 is an embodiment which shows a tea light candle holder 30 having a tea light candle insert 34. a spill proof wax cup 39. In a preferred embodiment the spill proof wax cup 39 is made of a clear plastic. FIG. 4 shows that the tea light candle 34 has an automatic shut-off 38, which shows that once the tea light candle 34 burns out, it automatically shuts off as shown by 38. FIG. 4 further shows a translucent candle design 35.

The invention claimed is:

1. A safety candle consisting of:

a tea light candle holder;

at least one tea light candle insert placed inside a spill proof wax cup which is placed internally in said tea light candle holder;

said spill proof wax cups preventing leaking.

2. A safety candle comprising:

a tea light candle holder;

at least one tea light candle insert placed inside a clear plastic wax cup which is placed internally in said tea light candle holder;

said tea light candle holder having translucent candle designs.

* * * * *